United States Patent [19]

Wilczynski

[11] 4,060,303

[45] Nov. 29, 1977

[54] FUSED IN-LINE POWER CONNECTOR ARRANGEMENT

[75] Inventor: Mieczyslaw Wilczynski, Fort Lauderdale, Fla.

[73] Assignee: Motorola, Inc., Schaumburg, Ill.

[21] Appl. No.: 773,721

[22] Filed: Mar. 2, 1977

[51] Int. Cl.[2] ..... H01H 85/50

[52] U.S. Cl. ..... 339/147 R; 337/188; 337/198; 339/89 R

[58] Field of Search ..... 339/147 R, 147 P, 182 R, 339/204, 205, 189 R, 89 R, 90 R; 337/188, 197, 198, 207, 208

[56] References Cited

U.S. PATENT DOCUMENTS

| | | | |
|---|---|---|---|
| 3,116,386 | 12/1963 | Sperzel | 337/198 X |
| 3,281,558 | 10/1966 | Weber | 337/188 |
| 3,551,869 | 12/1970 | Robinson | 339/147 R X |

*Primary Examiner*—Roy Lake
*Assistant Examiner*—E. F. Desmond
*Attorney, Agent, or Firm*—Donald B. Southard; James W. Gillman

[57] ABSTRACT

A combination power connector with in-line fuse holder is disclosed. The structure includes a power connector assembly wherein a replaceable fuse is interposed in the power line and a two-piece jack assembly in the ground line. Disconnecting the connector assembly also facilitates the replacement of a fuse, if necessary. The structure includes a twist or retainer lock ring overlying respective halves of the connector assembly and releasably locks the respective connector components in the assembled relation. A pliant, two-piece insulating cover completes the assembly.

3 Claims, 5 Drawing Figures

FUSED IN-LINE POWER CONNECTOR ARRANGEMENT

BACKGROUND OF THE INVENTION

The present invention relates generally to power connector assemblies and, more particularly, to an improved combination power connector with self-contained in-line fuse holder as an integral part of the overall assembly.

For electrical or electronic apparatus, generally, it is more often than not necessary to provide a power connection arrangement whereby the power connection can be broken or otherwise detached to facilitate servicing or other requirements. Usually this interruption of power breaks of interrupts the connection for both the power line and the ground line. Normally, this is effected by a two-piece connector assembly having both power and ground lines connected therethrough.

In addition, however, it is frequently necessary to also provide an appropriate fusing device interposed in the power line itself for short circuit protection and other current overload. Until now, this required a separate connector assembly or holder to accommodate the necessary fuse element. This complicates the structure and renders it substantially more cumbersome than desired and, further, increases the cost because two separate connector assemblies are required.

SUMMARY OF THE INVENTION

Accordingly, it is an object of the present invention to provide an improved combination power connector with in-line fuse holder suitable for use with any application requiring power connection and fusing at the same time.

A more particular object of the present invention is to provide a combination power connector and in-line fuse holder wherein the connector assembly is designed to accommodate the fuse element itself and which includes a locking ring for releasably attaching the respective component parts.

In practicing the invention, a connector assembly is provided which incorporates substantially identical housing connector elements and an interconnecting lock ring. The respective connector elements interfit with one another and accommodate a standard fusing element in the position to which the operating power line is interconnected. The ground line is interconnected through a male and female jack assembly. Upon the connector elements being interfitted with one another, the lock ring is rotated slightly to lock a projection within an L-shaped slot. The assembly is completed by a pliant, two-piece insulating cover wherein one overlies a portion of the other.

BRIEF DESCRIPTION OF THE DRAWINGS

The features of the present invention which are believed to be novel are set forth with particularity in the appended claims. The invention, itself, together with further objects and advantages thereof, may best be understood by reference to the accompanying drawings, in which:

DESCRIPTION OF THE PREFERRED EMBODIMENT

Figure 1:
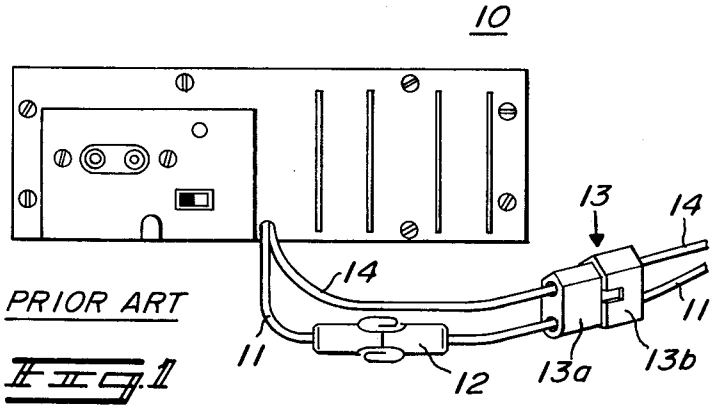
PRIOR ART FIG. 1
FIG. 1 is a graphic representation of conventional radio apparatus requiring a separate power connector and in-line fuse holder arrangement typical of the prior art.

As shown in FIG. 1, the typical prior art installation includes a power connector arrangement separate and independent from the fuse assembly for the associated electronic apparatus, shown generally at 10. The "hot" line, or conductor with the voltage level above ground, here identified generally at 11, includes an in-line fuse holder arrangement 12 for fusing the apparatus 10 at its proper operating power level. However, a power connector assembly 13 is also provided which is completely separate and independent from the fuse connector assembly 12. Power connector 13 includes a pair of interfitting connector component parts **13*a* and 13*b* for making and breaking electrical continuity for both the power line 11 and ground line 14**.

Figure 2:
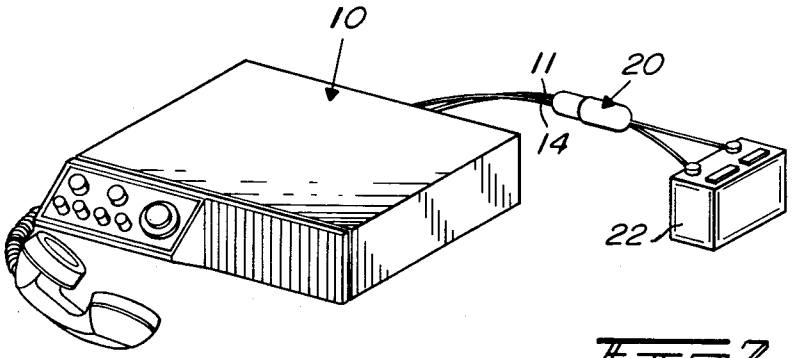
FIG. 2 is a graphic representation of radio apparatus wherein a combination power connector assembly and in-line fuse holder are combined in a single unit, which combination power connector and fuse holder has been constructed in accordance with the present invention.

As shown in FIG. 2, a single connector assembly 20 may be utilized between an associated electrical or electronic apparatus, identified at 10, and a source of operating power, illustrated here as a conventional direct current battery device 22. The connector assembly 20 includes provision for both making and breaking electrical continuity between the power and ground lines as well as accommodating an in-line fuse element internal of its connector assembly.

Figure 3:
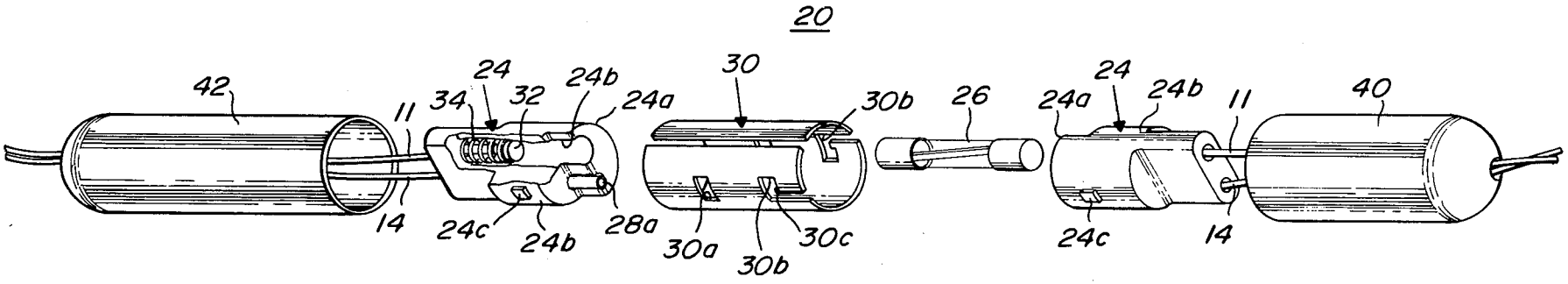
FIG. 3 is an enlarged exploded view of the combination power connector and in-line fuse holder arrangement as shown in FIG. 2.
Figure 5:
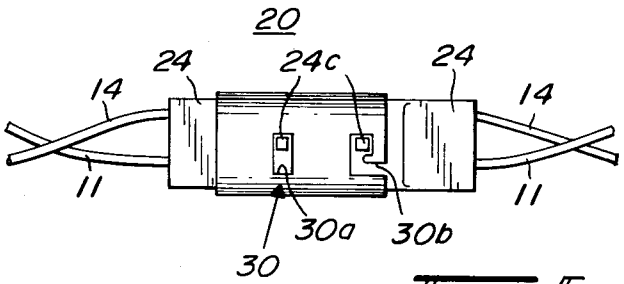
FIG. 5 is an elevational side view of the connector assembly in its assembled and connected position.

The structure of the connector assembly 20 can be more readily appreciated by reference to FIG. 3. As illustrated, the connector assembly 20 includes a pair of substantially identical connector elements, identified generally at 24, which are designed to interfit with one another. Each of the connector elements 24 includes a forward portion **24*a* and a stepped down body portion 24*b*. A dimple or projection 24*c* is included on the body surface of the connector elements 24. Each of the connector elements 24 include a pair of cavities therein, namely, a larger cavity 24*d* and a smaller cavity 24*e* laterally displaced therefrom. The larger of the cavities, i.e., 24*d*, is intended to accommodate a conventional glass tube fuse element 26 therein and the smaller cavity 24*e* is intended to accommodate respective components of a jack assembly, i.e., a female component 28*a* and a male component 28*b*. In assembly, connector component elements 24 are aligned, and the forward portions 24*a* positioned in a side-by-side relation with the fuse element 26 completely contained within the respective cavity portions 24*d*. In addition, the male jack assembly component 28*b* inserts within the female component 28*a***.

Figure 4:
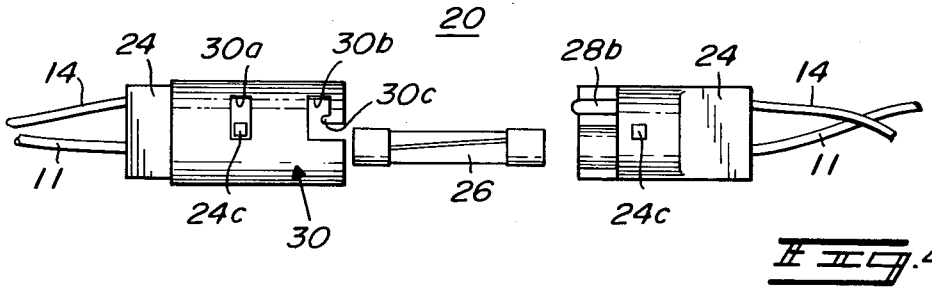
FIG. 4 is a view in side elevation of the connector assembly in its disconnected position.

As also shown in the drawings, a retainer or lock ring 30 is provided whereby the two connector elements 24 can be retained and locked in assembled relation. As shown, the retainer 30 is in the form of a split ring which slides over one of the connector component elements 24 and wherein a pair of apertures **30*a* on respective sides of the ring 30 are placed over and capture corresponding projections 24*c*** (see FIG. 4). At the other end of the retainer ring are a pair of L-shaped slots 30*b* in which the projections 24*c* of the other connector component 24 may be inserted and rotated to lock the two component parts together. The laterally extending tab 30*c* in each of the slots 30*b* provides a locking action in conjunction with a spring element 34 in the body of the connector elements 24.

As also shown in FIG. 3, the power line 11 is soldered into a flanged eyelet 32 forming a base for the glass tube fuse. In addition, the small spring element 34 is included around the base of eyelet 32 to provide the required spring compression to ensure electrical continuity between the eyelet and the fuse and to provide the locking action of the projection 24*c* within the slot 30*b* of retaining ring 30.

To complete the assembly, a pair of covers, 40 and 42, are provided which are intended to overlie the connector assembly 20 itself. Covers 40 and 42 are preferably formed of a pliant, plastic material and wherein one of the covers, say, cover 40, includes a somewhat enlarged opening which will overlie the outside diameter of the other cover 42.

Accordingly, what has been disclosed is an improved power connector assembly which includes an in-line fuse holder capability suitable for application with electronic apparatus of any sort which requires a power connection and fusing at the same time. Two separate units have been avoided, substantial reductions in cost have been effected and the device may be fabricated of components which require minimized tooling cost.

Accordingly, what is claimed is:

1. An improved power connector arrangement with self-contained in-line fusing device, comprising in combination:

a pair of substantially identical connector elements for interfitting each with the other, each of said connector elements having a forward reduced portion and a pair of laterally displaced but longitudinally extending openings therein, one of said openings being capable of retaining a glass tube fuse device therein and the other of said openings being capable of retaining respective portions of a jack assembly, said connector elements further including a pair of up-raised projections on the surfaces thereof; and a split-ring retainer member having a pair of slots at one end thereof for overfitting and capturing said projections on one of said connector elements, said retainer having a pair of L-shaped openings at the other end thereof for permitting the insertion of said projection of said other connector element and the rotation thereof laterally to effect a locking action.

2. An improved power connector arrangement with self-containing in-line fuse device in accordance with claim 1 wherein said locking action is provided by tab members extending laterally within said L-shaped openings which are spring biased into engagement with said projections of said other of said connector elements by spring means contained within the cavity formed by said connector elements that house said fuse element.

3. An improved power connector arrangement with self-contained in-line fuse device in accordance with claim 1 wherein said connector arrangement includes a pliant cover of insulating material overlying each of said connector elements, one of said covers inserting into the other of said covers a given distance upon engagement of said connector elements.

* * * * *